US009801237B2

(12) United States Patent
Oh et al.

(10) Patent No.: US 9,801,237 B2
(45) Date of Patent: Oct. 24, 2017

(54) ELECTRONIC INDUCTION HEATING COOKER AND OUTPUT LEVEL CONTROL METHOD THEREOF

(71) Applicant: LG ELECTRONICS INC., Seoul (KR)

(72) Inventors: Dooyong Oh, Seoul (KR); Heesuk Roh, Seoul (KR); Byeongwook Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 655 days.

(21) Appl. No.: 14/010,570

(22) Filed: Aug. 27, 2013

(65) Prior Publication Data

US 2014/0151365 A1 Jun. 5, 2014

(30) Foreign Application Priority Data

Dec. 3, 2012 (KR) ..... 10-2012-0139087

(51) Int. Cl.
*H05B 6/06* (2006.01)
*H05B 6/08* (2006.01)

(52) U.S. Cl.
CPC ..... *H05B 6/065* (2013.01)

(58) Field of Classification Search
CPC ..... H05B 6/065
USPC ..... 219/662
See application file for complete search history.

(56) References Cited

U.S. PATENT DOCUMENTS 5,951,904 A * 9/1999 Jung ..... H05B 6/04 219/626
2011/0074489 A1* 3/2011 Viitanen ..... H02M 1/08 327/427
2012/0152935 A1* 6/2012 Kitaizumi ..... H05B 6/065 219/661

FOREIGN PATENT DOCUMENTS

DE 69836312 5/2007

OTHER PUBLICATIONS

European Search Report dated Oct. 10, 2016.
Yong-Chae Jung; "Dual half bridge series resonant inverter for induction hearing appliance with two loads"; Electronic Letters; IEE Stevenage, GB, vol. 35, No. 16, Aug. 5, 1999, pp. 1345-1346, XP006012499.

* cited by examiner

*Primary Examiner* — David Angwin
*Assistant Examiner* — John J Norton
(74) *Attorney, Agent, or Firm* — Ked & Associates LLP

(57) ABSTRACT

An electronic induction heating cooker is provided. The electronic induction heating cooker may include a rectifier that rectifies an input voltage into a direct current (DC) voltage and output the DC voltage, an inverter including first, second and third switches connected in series between a positive power source terminal and a negative power source terminal to generate an alternating current (AC) voltage by switching the DC voltage, a first heater driven by the AC voltage so as to heat a first cooking container, a second heater connected in parallel to the first heater and driven by the AC voltage so as to heat a second cooking container, and a switching controller that generates a switching signal for controlling the first and second heaters in accordance with a set of operating conditions input thereto and adjusts a duty cycle of the switching signal.

15 Claims, 17 Drawing Sheets

THIRD OPERATION MODE
(FIRST AND SECOND RESONANT CIRCUITS: POWER LOWER THAN MAXIMUM POWER BY AMOUNT CORRESPONDING TO "d")

FOURTH OPERATION MODE
(FIRST RESONANT CIRCUIT; MAXIMUM POWER
SECOND RESONANT CIRCUIT; MAXIMUM POWER)

FOURTH OPERATION MODE
(FIRST RESONANT CIRCUIT: POWER LOWER THAN MAXIMUM POWER BY AMOUNT CORRESPONDING TO "d"
SECOND RESONANT CIRCUIT: POWER LOWER THAN MAXIMUM POWER BY AMOUNT CORRESPONDING TO "c")

ELECTRONIC INDUCTION HEATING COOKER AND OUTPUT LEVEL CONTROL METHOD THEREOF

CROSS-REFERENCE TO RELATED APPLICATION(S)

This application claims priority under 35 U.S.C. §119 to Korean Application No. 10-2012-0139087 filed on Dec. 3, 2012, whose entire disclosure is hereby incorporated by reference.

BACKGROUND

1. Field

Embodiments relate to an electronic induction heating cooker.

2. Background

Induction heating cookers may perform a cooking function by applying a high-frequency current to working coils or heating coils so as to generate lines of induction and heat a cooking container using an eddy current generated by the lines of induction.

BRIEF DESCRIPTION OF THE DRAWINGS

The embodiments will be described in detail with reference to the following drawings in which like reference numerals refer to like elements wherein.

DETAILED DESCRIPTION

Figure 1:
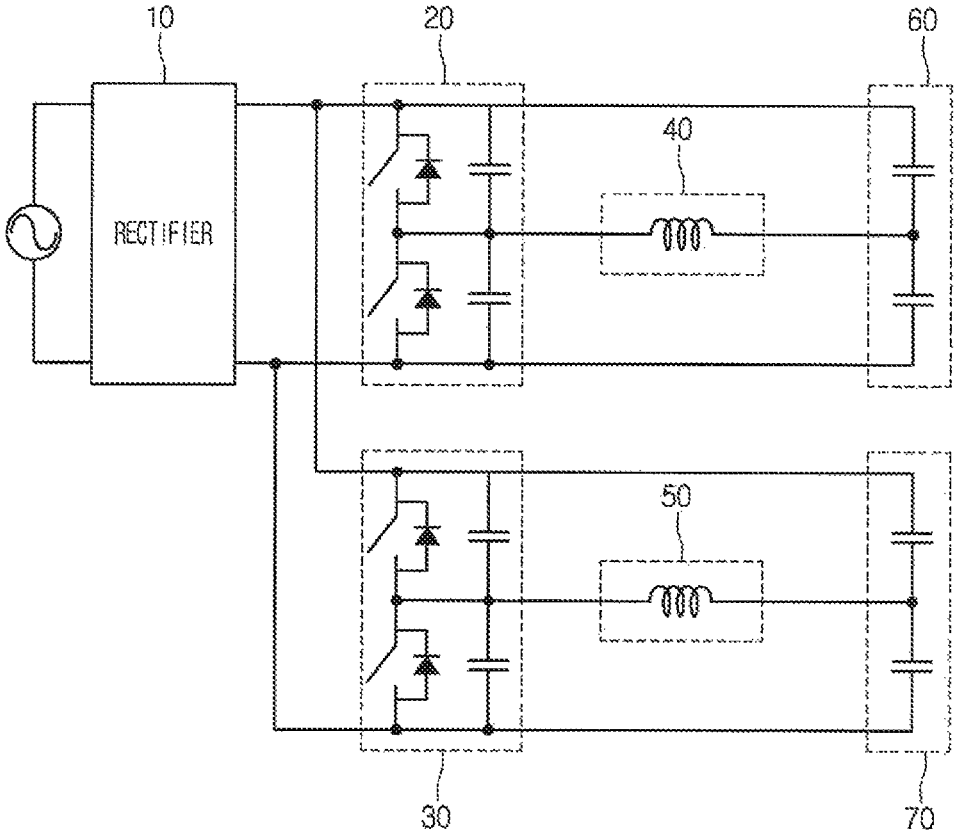
FIGS. 1 and 2 are circuit diagrams of exemplary induction heating cookers.

The following description exemplifies only the principles of the various embodiments as broadly described herein. Even if not described or illustrated in detail, one of ordinary skill in the art can embody the principles within the concept and scope of the present disclosure. The conditional terms and embodiments presented are intended only to make understood the various concepts, and are not limited to the embodiments and conditions mentioned in the specification.

In addition, the detailed description of the principles, viewpoints and embodiments and particular embodiments may be understood to include structural and functional equivalents to them. The equivalents may include not only the currently known equivalents but also those to be developed, that is, all devices developed to perform the same function, regardless of their structures.

In the claims, an element expressed as a means for performing a function described in the detailed description is intended to include all methods for performing the function including all formats of software, such as a combination of circuits that performs the function, firmware/microcode, and the like. To perform the intended function, the element may cooperate with a proper circuit for performing the software. Embodiments defined by claims may include diverse means for performing particular functions, and the means are connected with each other in a method requested in the claims. Therefore, any means that can provide the function may be understood to be an equivalent to what is derived from the present specification.

Other objects and aspects of the various embodiments will become apparent from the following description, with reference to the accompanying drawings, which is set forth hereinafter. The same reference numeral will be given to the same element, although the element appears in different drawings, and if further duplicate detailed description may be omitted. In this disclosure, the terms "module" and "unit" may be used interchangeably.

When a current is applied to a heating coil of an induction heating cooker, a cooking container including a magnetic substance may generate heat through induction heating and then be heated so as to perform a cooking function. An inverter for use in such an induction heating cooker may switch a voltage applied to a heating coil of the induction heating cooker so that a high-frequency current may flow into the heating coil. The inverter may generate a high-frequency magnetic field in the heating coil by driving a switching device, which includes an insulated gate bipolar transistor (IGBT), so as to flow a high-frequency current into the heating coil. In a case in which two heating coils are provided in an induction heating cooker, two inverters may drive the two heating coils at the same time. If only one inverter is provided to drive the two heating coils, separate switches may be provided for the two heating coils so that the two heating coils may be selectively driven.

Figure 2:
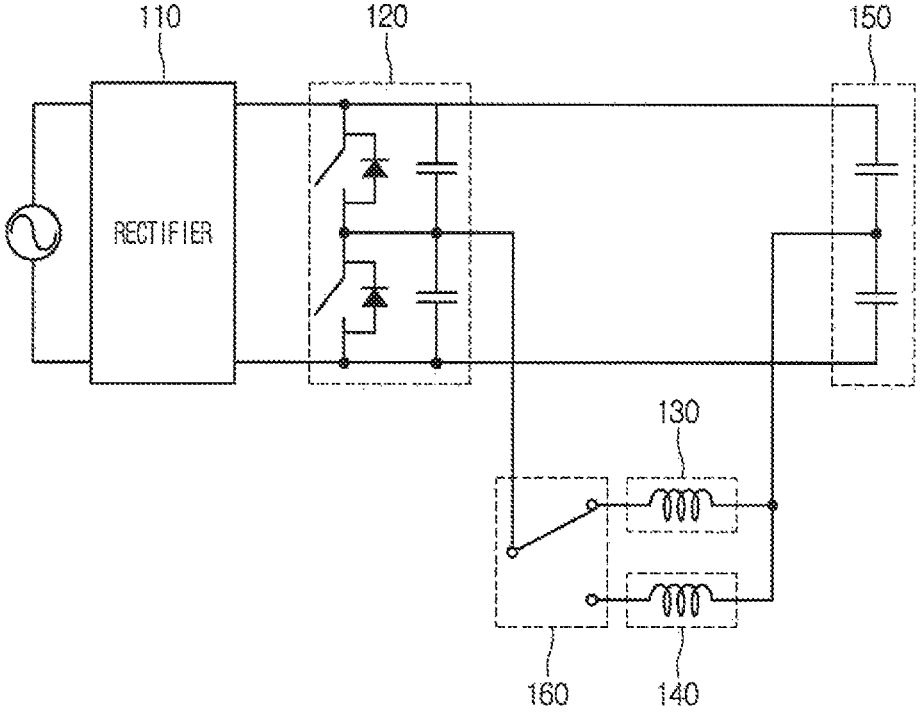

FIG. 1 is a circuit diagram of an induction heating cooker including two inverters and two heating coils, and FIG. 2 is a circuit diagram of an induction heating cooker including one inverter and two heating coils.

The induction heating cooker shown in FIG. 1 may include a rectifier 10, a first inverter 20, a second inverter 30, a first heating coil 40, a second heating coil 50, a first resonant capacitor 60, and a second resonant capacitor 70.

The first and second inverters 20 and 30 may be connected in series to a first switching device that switches input power. The first and second heating coils 40 and 50 may be driven by an output voltage of the first switching device. The first and second inverters 20 and 30 may be also connected to a connection node of a second switching device to which the first and second heating coils 40 and 50 are connected in series. The first and second heating coils 40 and 50 may also be connected to the resonant capacitors 60 and 70.

The first and second switching devices may be driven by a driving device. More specifically, the first and second switching devices may apply a high-frequency voltage to the first and second heating coils 40 and 50 while being alternately driven in accordance with switching time information output by the driving device. Since the on/off time of the first and second switching devices is controlled so as to be gradually compensated for by the driving device, the voltage applied to the first and second heating coils 40 and 50 may change from a low level to a high level. However, the induction heating cooker of FIG. 1 needs two inverters to properly drive the two heating coils, increasing product size and manufacturing cost.

The induction heating cooker shown in FIG. 2 may include a rectifier 110, an inverter 120, a first heating coil 130, a second heating coil 140, a resonant capacitor 150, and a switch 160 so that one of the first or second heating coils 130 and 140 may be driven by a single inverter, i.e., the inverter 120. Which of the first or second heating coils 130 and 140 is to be driven is determined by the switch 160. However, in the induction heating cooker of FIG. 2, because one of the first or second heating coils 130 and 140 is chosen by the switch 160, noise may be generated. In addition, since only one of the first or second heating coils 130 and 140 is driven, or the first and second heating coils 130 and 140 are alternatively driven, the output of the induction heating cooker of FIG. 2 may decrease.

Figure 3:
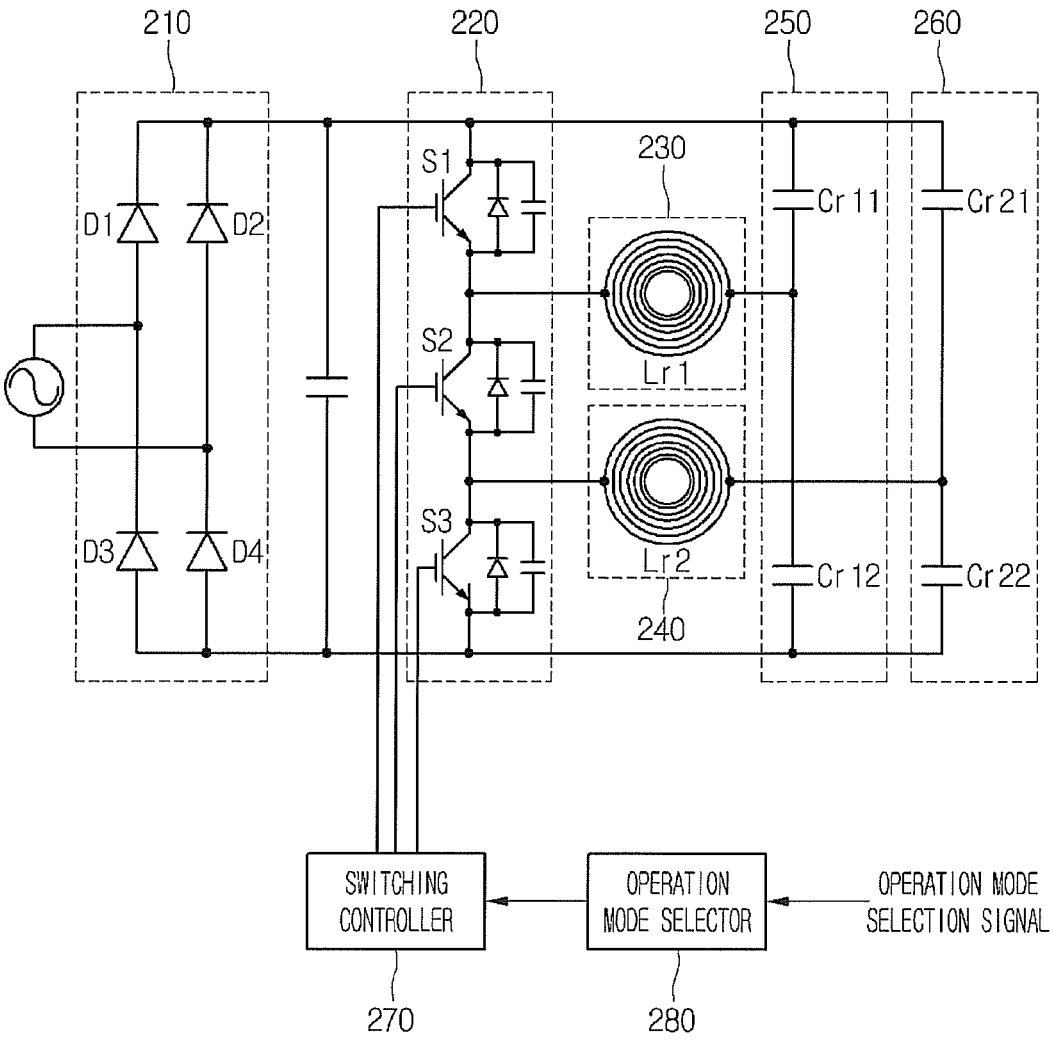
FIG. 3 is a circuit diagram of an electronic induction heating cooker according to an embodiment as broadly described herein.

FIG. 3 is a circuit diagram of an electronic induction heating cooker according to an embodiment as broadly described herein. Referring to FIG. 3, an electronic induction heating cooker 200 includes a rectification device 210 which receives a common alternating current (AC) voltage from an external source and rectifies the AC voltage into a direct current (DC) voltage, an inverter 220 connected in series between a positive power source terminal and a negative power source terminal and provides a resonant voltage by being switched in accordance with a control signal, a first heating coil 230 (Lr1) connected to the output terminal of the inverter 220, a second heating coil 240 (Lr2) connected to the output terminal of the inverter 220 and is also connected in parallel to the first heating coil 230, a first resonant capacitor device 250 including a plurality of first resonant capacitors Cr11 and Cr12 that are connected in parallel to each other, a second resonant capacitor device 260 including a plurality of second resonant capacitors Cr21 and Cr22 that are connected in parallel to each other, a switching controller 270 which applies different switching signals for different operation modes to each switch included in the inverter 220, and an operation mode selector 280 which receives an operation mode selection signal from an external source and applies the received operation mode selection signal to the switching controller 270. The electronic induction heating cooker 200 may also include a smoothing capacitor.

The rectification device 210 includes a first rectifier D1, a second rectifier D2, a third rectifier D3, and a fourth rectifier D4. The first and third rectifiers D1 and D3 are connected in series to each other, and the second and fourth rectifiers D2 and D4 are connected in series to each other.

The inverter 220 includes a plurality of switches, for example, first, second, and third switches S1, S2, and S3. A first end of the first switch S1 is connected to a positive power source terminal, and a second end of the first switch S1 is connected to a first end of the second switch S2. The first end of the second switch S2 is connected to the second end of the first switch S1, and a second end of the second switch S2 is connected to a first end of the third switch S3. The first end of the third switch S3 is connected to the second end of the second switch S2, and a second end of the third switch S3 is connected to a negative power source terminal.

A first end of the first heating coil 230 is connected to the connection node between the second end of the first switch S1 and the first end of the second switch S2, and a second end of the first heating coil 230 is connected between the first resonant capacitors Cr11 and Cr12. A first end of the second heating coil 240 is connected to the connection node between the second end of the second switch S2 and the first end of the third switch S3, and a second end of the second heating coil 240 is connected between the second resonant capacitors Cr21 and Cr22.

The first heating coil 230 and the first resonant capacitor device 250 may form a first resonant circuit and may operate as a first burner. The second heating coil 240 and the second resonant capacitor device 260 may form a second resonant circuit and may operate as a second burner.

An anti-parallel diode is connected to each of the first, second, and third switches S1, S2, and S3 of the inverter 220. To minimize switching loss at each of the first, second, and third switches S1, S2, and S3 of the inverter 220, an auxiliary resonant capacitor is connected in parallel to the anti-parallel diode.

The switching controller 270 is connected to the gates of the first, second, and third switches S1, S2, and S3, and outputs a gate signal for controlling the switching state of the first, second, and third switches S1, S2, and S3. The gate signal may be a signal that determines the switching state of the first, second, and third switches S1, S2, and S3.

The operation mode selector 280 receives a selection of an operation mode for the electronic induction heating cooker 200 from an external source. The operation mode for the electronic induction heating cooker 200 may include first, second, third, and fourth operation modes. The first operation mode may drive only the first heating coil 230 so that an eddy current is induced only in a cooking container on the first heating coil 230. The second operation mode may drive only the second heating coil 230 so that an eddy current is induced only in a cooking container on the second heating coil 240. The third operation mode may drive both the first and second heating coils 230 and 240 at the same time so that an eddy current is induced in both the cooking containers on the first and second heating coils 230 and 240. The fourth operation mode may alternately drive the first and second heating coils 230 and 240 so that an eddy current is induced in the cooking container on the first heating coil 230 for a first period of time, and is induced in the cooking container on the second heating coil 240 for a second period of time.

In short, the switching controller 270 provides a switching signal to each of the first, second, and third switches S1, S2, and S3 according to an operation mode selected by the operation mode selector 280.

More specifically, in response to the first operation mode being selected, the switching controller 270 outputs a switching signal to the first, second, and third switches S1, S2, and S3 such that only the first resonant circuit may be selectively driven. In response to the second operation mode being selected, the switching controller 270 outputs a switching signal to the first, second, and third switches S1, S2, and S3 such that only the second resonant circuit may be selectively driven. In response to the third operation mode being selected, the switching controller 270 outputs a switching signal to the first, second, and third switches S1, S2, and S3 such that the first and second resonant circuits may both be driven at the same time. In response to the fourth operation mode being selected, the switching controller 270 outputs a switching signal to the first, second, and third switches S1, S2, and S3 such that the first and second resonant circuits may be alternately driven.

A switching signal for an operation mode selected and the operation of the electronic induction heating cooker 200 in accordance with the switching signal will hereinafter be described.

Figure 4:
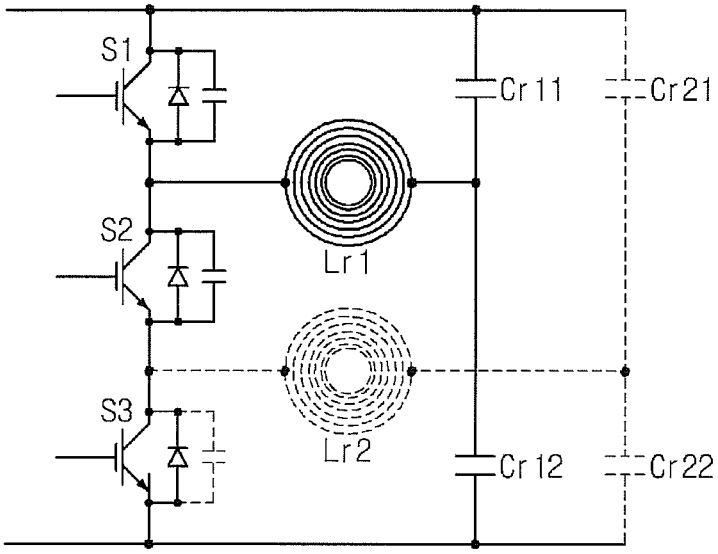
FIG. 4 is a circuit diagram of a first operation mode of the electronic induction heating cooker shown in FIG. 3.
Figure 5:
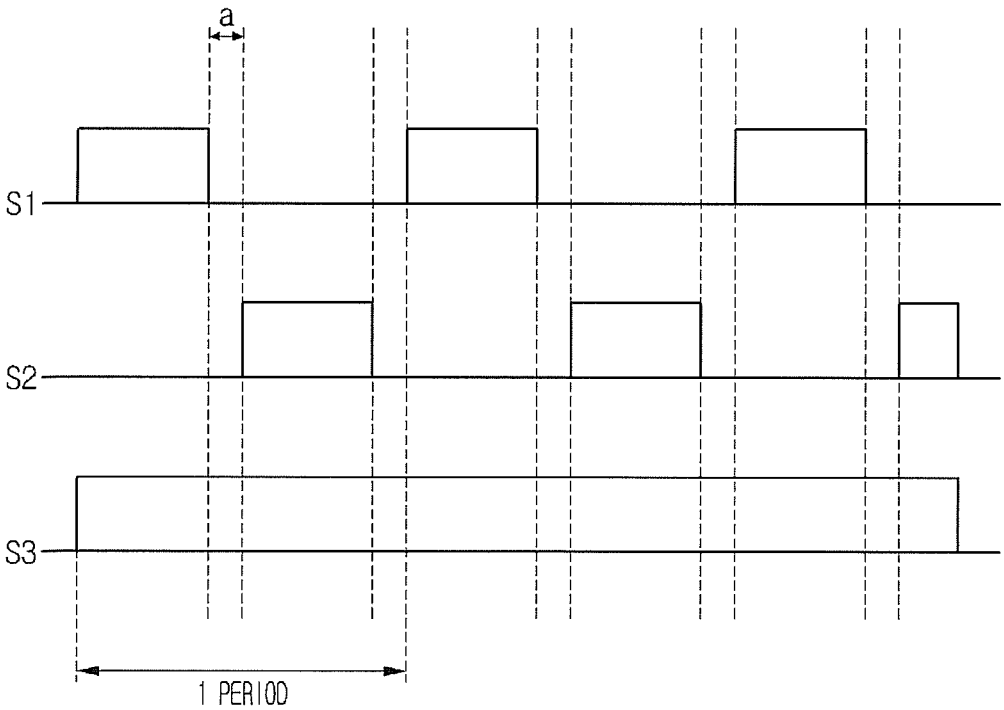
FIG. 5 is a diagram of a first switching signal according to an embodiment.
Figure 6:
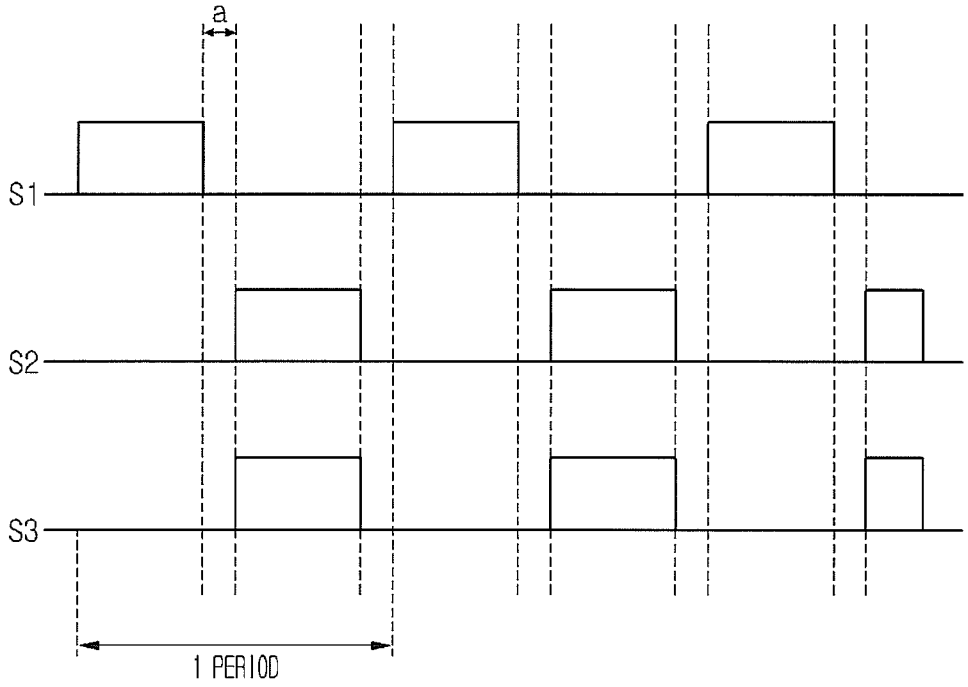
FIG. 6 is a diagram of a first switching signal according to another embodiment.

FIG. 4 is a circuit diagram of the electronic induction heating cooker 200 in the first operation mode, FIG. 5 is a diagram of a first switching signal according to an embodiment, and FIG. 6 is a diagram of a first switching signal according to another embodiment.

Referring to FIGS. 4 to 6, in response to the first operation mode being selected, the switching controller 270 outputs a first switching signal to the first, second, and third switches S1, S2, and S3.

More specifically, the switching controller 270 may control the third switch S3 to continue to be closed, may control the second switch S2 to be open, and may control the first switch S1 to be closed. In a case in which the first and third switches S1 and S3 are closed and the second switch S2 is open, an input voltage Vd is applied to the first heating coil 230 and the first resonant capacitors Cr11 and Cr12. As a result, the first resonant capacitors Cr11 and Cr12 begin to resonate, and the current of the first heating coil 230 increases. During a first half of a resonant period, the first and third switches S1 and S3 may continue to be closed and the second switch S2 may continue to be open.

The switching controller 270 opens the first switch S1 from a "zero voltage" condition after a lapse of less than half of the resonant period. Then, if the first switch S1 is opened by the switching controller 270, the auxiliary resonant capacitors respectively connected to the first and second switches S1 and S2 perform auxiliary resonance. As a result, the voltage of the auxiliary resonant capacitor connected to the second switch S2 drops from the input voltage Vd to zero, and the voltage of the auxiliary resonant capacitor connected to the first switch S1 increases from zero to the input voltage Vd.

Then, a current is applied to the anti-parallel diode connected to the second switch S2, and thus, a zero voltage is applied to the first heating coil 230. Accordingly, due to continued resonance, the current of the first heating coil 230 drops to zero.

In response to the current of the first heating coil 230 reaching zero, the switching controller 270 controls the second switch S2 to be closed in a "zero voltage/zero current" condition. In this manner, switching loss at the first, second, and third switches 51, S2, and S3 may be minimized.

In response to the second switch S2 being closed, the input voltage Vd is inversely applied to the first heating coil 230. As a result, due to resonance, the current of the first heating coil 230 increases. That is, during the rest of the resonant period, the second and third switches S2 and S3 are closed, and the first switch S1 is open.

The switching controller 270 releases the second switch S2 from the "zero voltage" condition after a lapse of less than half of the resonant period. As a result, the auxiliary resonant capacitors respectively connected to the first, second, and third switches S1, S2, and S3, the first heating coil 230 and the first resonant capacitors Cr11 and Cr12 perform auxiliary resonance. Accordingly, the voltage of the auxiliary resonant capacitor connected to the first switch drops from the input voltage Vd to zero, and the voltage of the auxiliary resonant capacitor connected to the second switch S2 increases from zero to the input voltage Vd.

Then, a current is applied to the anti-parallel diode connected to the first switch S1, and thus, a zero voltage is applied to the first heating coil 230. Accordingly, due to continued resonance, the current of the first heating coil 230 drops to zero.

In response to the current of the first heating coil 230 reaching zero, the switching controller 270 controls the first switch S1 to be closed in the "zero voltage/zero current" condition. In this manner, switching loss at the first, second, and third switches S1, S2, and S3 may be minimized.

In response to the above-mentioned switching of the first, second, and third switches S1, S2, and S3 being complete, the operation of the electronic induction heating cooker 200 for a single resonant period is complete, and the electronic induction heating cooker 200 may continue to perform the corresponding operation for subsequent resonant periods. The first switching signal may be as shown by Table 1 below.

TABLE 1

| | First Half of Resonant period | Second Half of Resonant period |
|---|---|---|
| First Switch | Closed | Open |
| Second Switch | Open | Closed |
| Third Switch | Closed | Closed |

The switching controller 270 controls the third switch S3 to continue to be open while controlling the first and second switches S1 and S2 to be alternately open or closed every half a resonant period.

In response to the first switching signal being applied, only the first heating coil 230 and the first resonant capacitors Cr11 and Cr12 may be driven, as illustrated in FIG. 4. The third switch S3 may not need to be closed all the time. That is, the switching state of the third switch S3, like that of the first and second switches S1 and S2, may vary. More specifically, the switching controller 270 may turn the third switch S3 on or off so that the opening or closing of the third switch S3 may be synchronized with the opening or closing of the second switch S2, as shown in Table 2 below.

TABLE 2

| | First Half of Resonant period | Second Half of Resonant period |
|---|---|---|
| First Switch | Closed | Open |
| Second Switch | Open | Closed |
| Third Switch | Open | Closed |

Referring to Table 2, the third switch S3 is open for half a resonant period and closed for the rest of the resonant period. Even in this example, only the first heating coil 230 and the first resonant capacitors Cr11 and Cr12 are driven.

Referring to FIGS. 5 and 6, reference character a indicates a dead time. Due to the provision of the dead time a, switching loss may be minimized.

Figure 7:
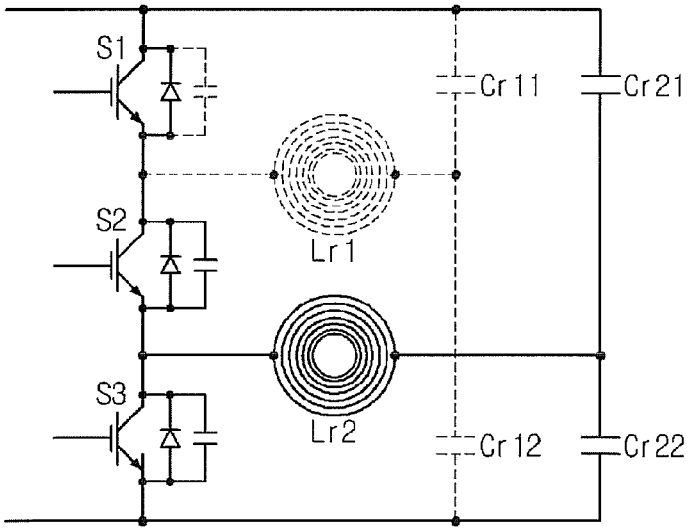
FIG. 7 is a circuit diagram of a second operation mode of the electronic induction heating cooker shown in FIG. 3.
Figure 8:
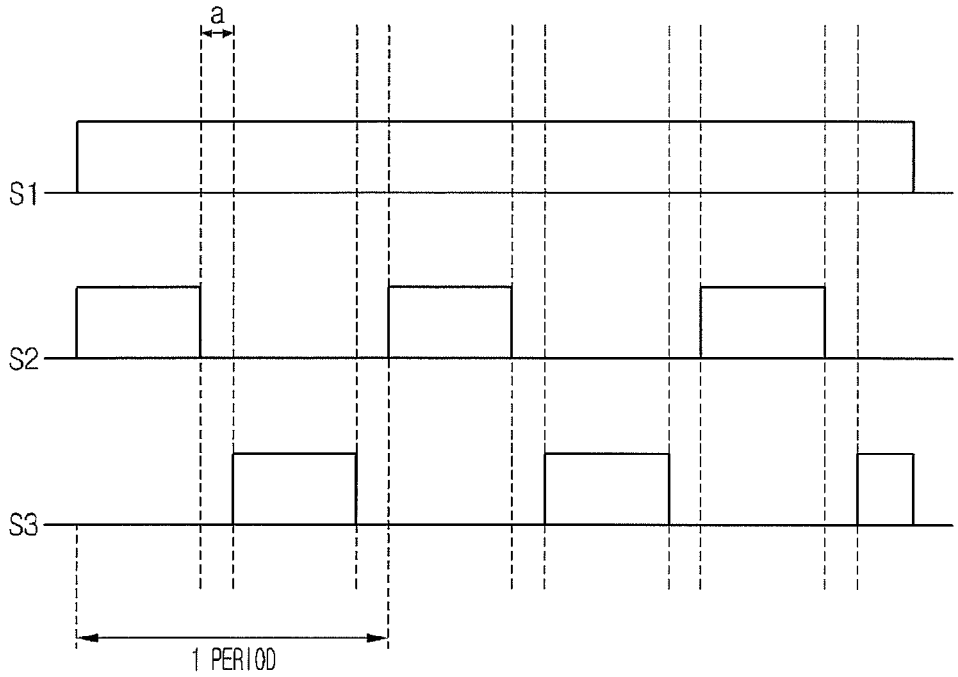
FIG. 8 is a diagram of a second switching signal according to an embodiment.
Figure 9:
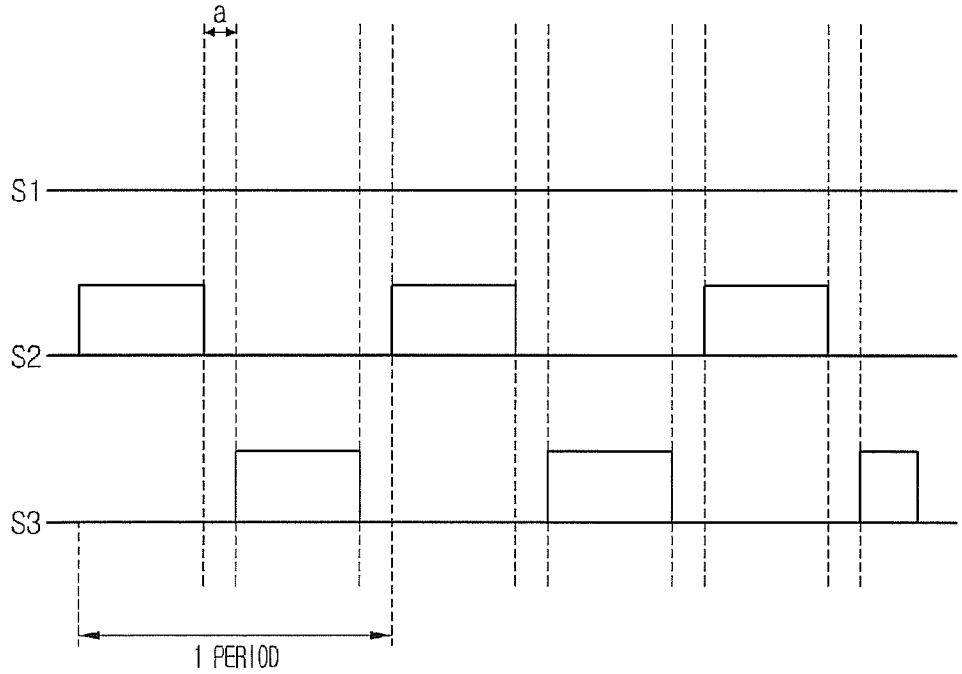
FIG. 9 is a diagram of a second switching signal according to another embodiment.

FIG. 7 is a circuit diagram of the electronic induction heating cooker 200 in the second operation mode, FIG. 8 is a diagram of a second switching signal according to an embodiment, and FIG. 9 is a diagram of a second switching signal according to another embodiment.

Referring to FIGS. 7 to 9, in response to the second operation mode being selected, the switching controller 270 outputs a second switching signal to the first, second, and third switches S1, S2, and S3. More specifically, the switching controller 270 may control the first switch S1 to continue to be closed, and may control the second and third switches S2 and S3 to be alternately open or closed. That is, during a first half of a resonant period, the switching controller 270 may control the first and second switches S1 and S2 to be closed and control the third switch S3 to be open. During a second half of the resonant period, the switching controller 270 may control the first and third switches S1 and S3 to be closed and may control the second switch S2 to be open. The first, second, and third switches S1, S2, and S3 may be switched on or off during the second operation mode, as shown in Table 3 below.

TABLE 3

| | First Half of Resonant period | Second Half of Resonant period |
|---|---|---|
| First Switch | Closed | Closed |
| Second Switch | Closed | Open |
| Third Switch | Open | Closed |

Alternatively, the switching controller 270 may control the first switch S1 to continue to be open while controlling the second and third switches S2 and S3 to be alternately open or closed, as shown in Table 4 below.

TABLE 4

| | First Half of Resonant period | Second Half of Resonant period |
|---|---|---|
| First Switch | Open | Open |
| Second Switch | Closed | Open |
| Third Switch | Open | Closed |

Referring to Tables 3 and 4, the switching controller 270 may control the first, second, and third switches S1, S2, and S3 in response to the second switching signal such that only the second heating coil 240 and the second resonant capacitors Cr21 and Cr22 are driven.

Figure 10:
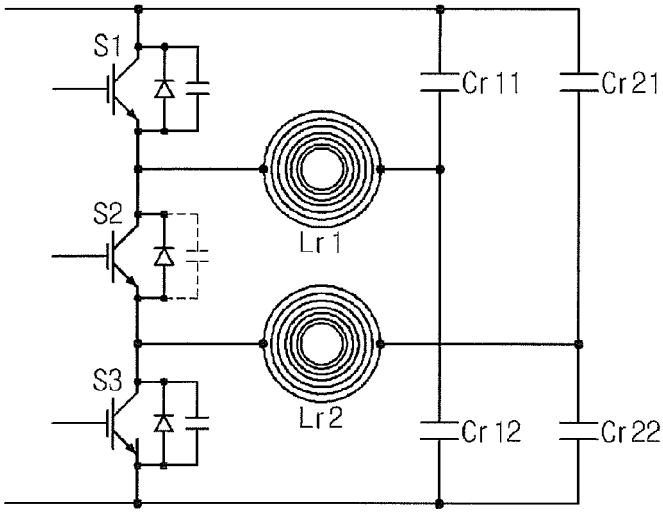
FIG. 10 is a circuit diagram of a third operation mode of the electronic induction heating cooker shown in FIG. 3.
Figure 11:
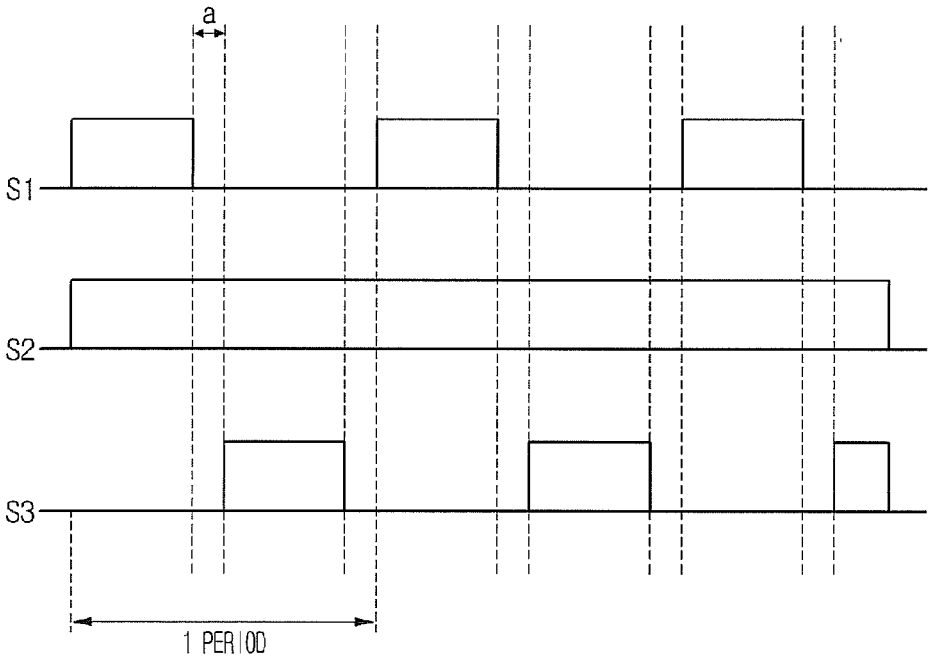
FIG. 11 is a diagram of a third switching signal according to an embodiment.

FIG. 10 is a circuit diagram of the electronic induction heating cooker 200 in the third operation mode, and FIG. 11 is a diagram of a third switching signal according to an embodiment.

Referring to FIGS. 10 and 11, in response to the third operation mode being selected, the switching controller 270 outputs a third switching signal to the first, second, and third switches S1, S2, and S3. More specifically, the switching controller 270 may control the second switch to continue to be closed, and may control the first and third switches S1 and S3 to be alternately open or closed. That is, during a first half of a resonant period, the switching controller 270 may control the first and second switches S1 and S2 to be closed, and may control the third switch S3 to be open. During a second half of a resonant period, the switching controller 270 may control the second and third switches S2 and S3 to be closed, and may control the first switch S1 to be open. The first, second, and third switches S1, S2, and S3 may be switched on or off during the third operation mode, as shown in Table 5 below.

TABLE 5

| | First Half of Resonant period | Second Half of Resonant period |
|---|---|---|
| First Switch | Closed | Open |
| Second Switch | Closed | Closed |
| Third Switch | Open | Closed |

Referring to Table 5, the switching controller 270 controls the first, second, and third switches S1, S2, and S3 in response to the third switching signal such that not only the first heating coil 230 and the first resonant capacitors Cr11 and Cr12 but also the second heating coil 240 and the second resonant capacitors Cr21 and Cr22 are driven.

Figure 12:
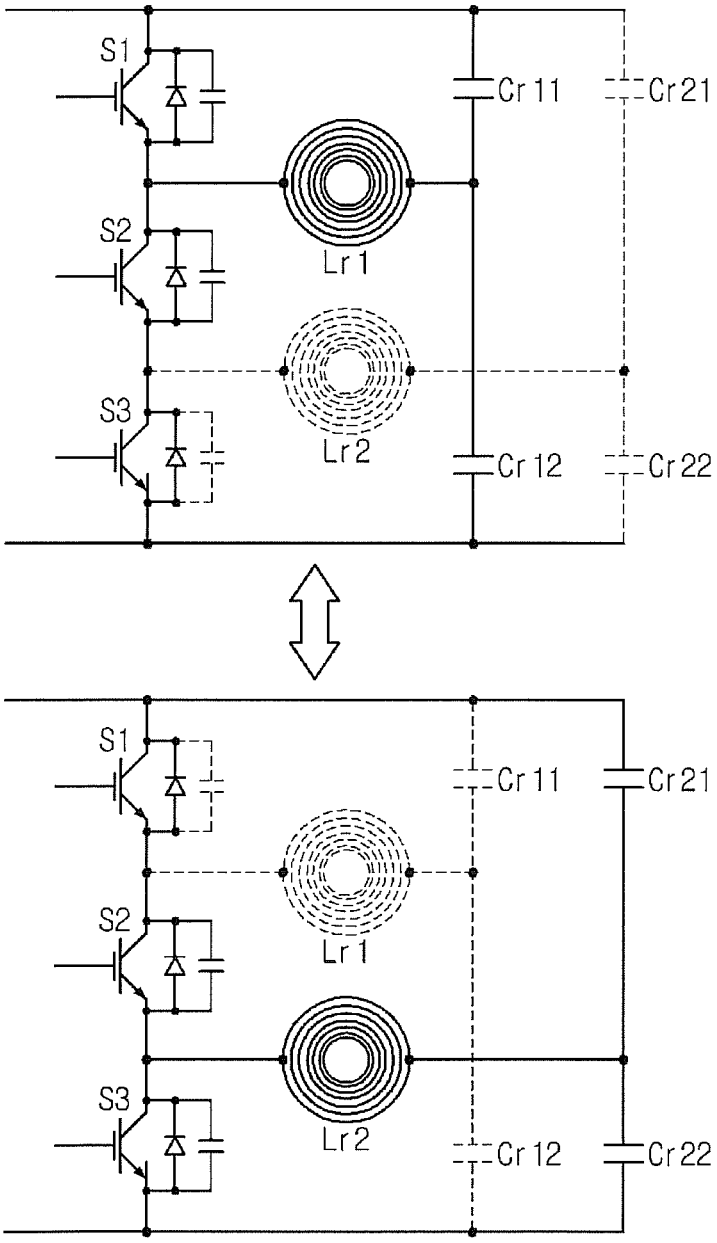
FIG. 12 is a circuit diagram of a fourth operation mode of the electronic induction heating cooker shown in FIG. 3.

FIG. 12 is a circuit diagram of the electronic induction heating cooker 200 in the fourth operation mode.

Referring to FIG. 12, in response to the fourth operation mode being selected, the switching controller 270 may output the first switching signal of Table 1 or 2 during a first resonant cycle, and may output the second switching signal of Table 3 or 4 during a second resonant cycle, which follows the first resonant cycle, as shown in Table 6 below.

TABLE 6

| | First Resonant period | | Second Resonant period | |
|---|---|---|---|---|
| | First Half | Second Half | First Half | Second Half |
| First Switch | Closed | Open | Closed | Closed |
| Second Switch | Open | Closed | Closed | Open |
| Third Switch | Closed | Closed | Open | Closed |

Referring to Table 6, the switching controller 270 may output a first switching signal during the first resonant period so as to drive the first heating coil 230 and the first resonant capacitors Cr11 and Cr12, and may output a second switching signal during the second resonant period so as to drive the second heating coil 240 and the second resonant capacitors Cr21 and Cr22.

Accordingly, as illustrated in FIG. 12, the first resonant circuit including the first heating coil 230 and the first resonant capacitors Cr11 and Cr12 and the second resonant circuit including the second heating coil 240 and the second resonant capacitors Cr21 and Cr22 are alternately driven.

According to embodiments, a plurality of heating coils may be driven by a single inverter with three switching devices. Therefore, y the circuitry of an induction heating cooker may be simplified and volume and manufacturing cost of an induction heating cooker may be reduced.

According to embodiments, it is possible to improve user satisfaction by driving a plurality of heating coils at the same time using a single inverter.

According to embodiments, there is no need to provide additional switches for driving a plurality of heating coils. Therefore, noise generated by such switches may be reduced/eliminated and reliability of an induction heating cooker may be improved.

It will hereinafter be described how to control the output level of each heating coil of the electronic induction heating coil 200 in each of the first, second, third, and fourth operation modes. Hereinafter, a switching signal used in the first operation mode, as shown in Table 1 or 2, is referred to as a first switching signal, a switching signal used in the second operation mode, as shown in Table 3 or 4, is referred to as a second switching signal, a switching signal used in the third operation mode, as shown in Table 5, is referred to as a third switching signal, and a switching signal used in the fourth operation mode, as shown in Table 6, is referred to as a fourth switching signal.

Figure 13:
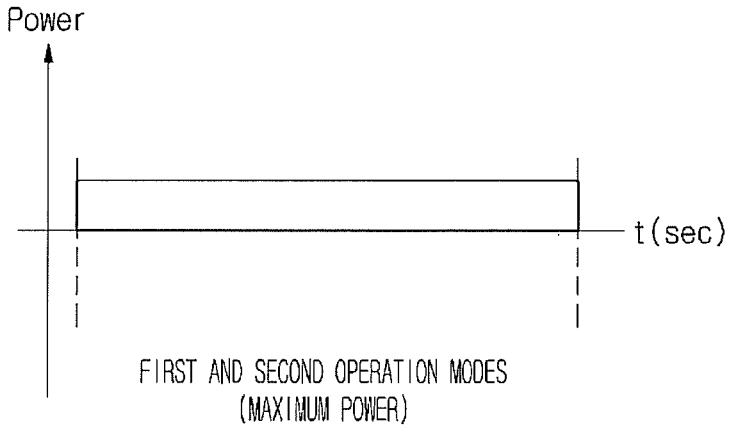
FIGS. 13 and 14 illustrate a method of controlling the output level of an electronic induction heating cooker in the first or second operation mode.
Figure 14:
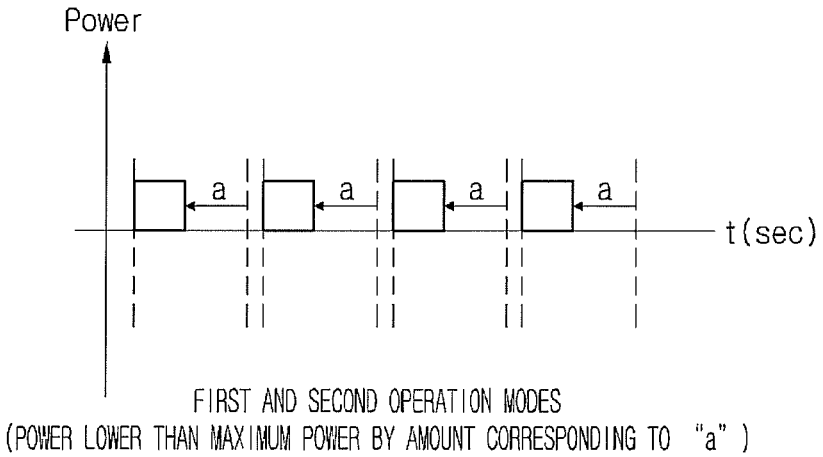

FIGS. 13 and 14 are diagrams illustrating a method of controlling the output level of the electronic induction heating cooker 200 in the first or second operation mode.

Referring to FIGS. 13 and 14, during the first operation mode, the first switching signal may continue to be output. In response to the first switching signal being continuously output, the output powers of the first resonant circuit including the first heating coil 230 and the first resonant capacitors Cr11 and Cr12 reach their maximum.

Similarly, during the second operation mode, the second switching signal may continue to be output. In response to the second switching signal being continuously output, the output power of the second resonant circuit, including the second heating coil 240 and the second resonant capacitors Cr21 and Cr22, reaches its maximum. That is, as illustrated in FIG. 13, in response to the first or second switching signal continuing to be output, i.e., in response to there only existing an "ON" period of the first or second switching signal, the output power of the first or second resonant circuit reaches its maximum.

The output power of the first or second resonant circuit may be adjusted by adjusting the "OFF" or "ON" period of the first or second switching signal for each resonant period, as illustrated in FIG. 14. For example, as illustrated in FIG. 14, an "OFF" period 'a' during which neither the first nor second switching signal is output is provided in each resonant period. During the "OFF" period 'a', the first or second resonant circuit stops operating, and thus, no power is generated.

Accordingly, due to the existence of the "OFF" period a in each resonant period, the output power of the first or second resonant circuit is reduced from the maximum as illustrated in FIG. 13 by as much as the amount of power not generated during the "OFF" period. That is, during the first or second operation mode, the "ON" and "OFF" periods of the first or second switching signal may be adjusted in response to receipt of a power adjustment command of burner inputted from an external source, thereby adjusting the output power of the first or second resonant circuit.

Figure 15:
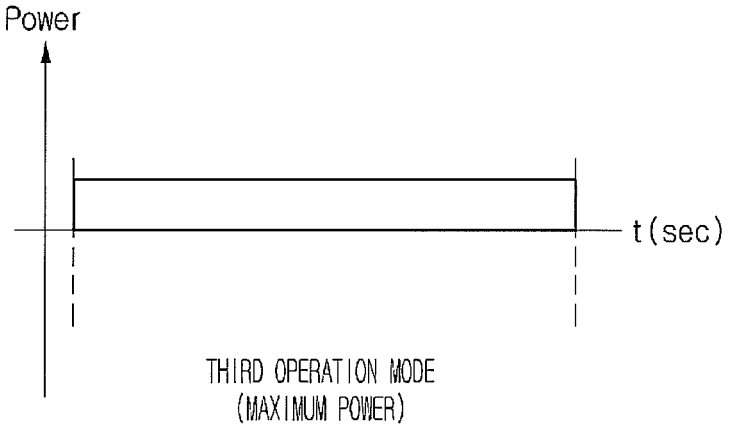
FIGS. 15 and 16 illustrate a method of controlling the output level of an electronic induction heating cooker in the third operation mode.
Figure 16:
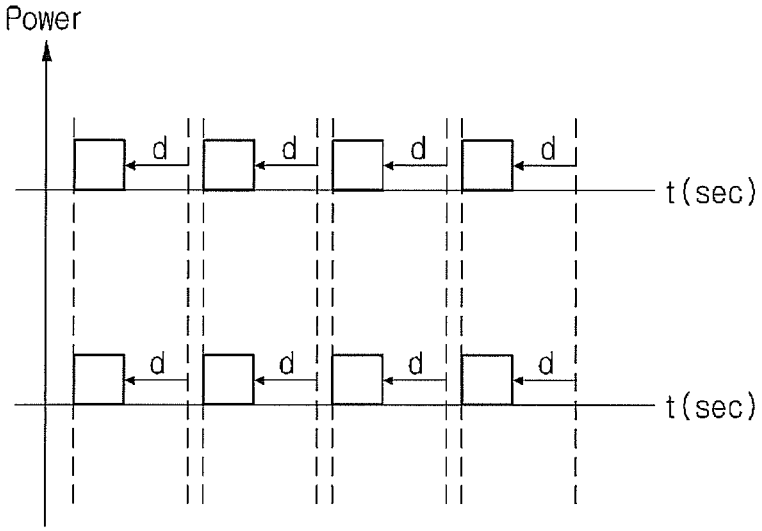

FIGS. 15 and 16 illustrate a method of controlling the output level of the electronic induction heating cooker 200 in the third operation mode.

Referring to FIGS. 15 and 16, during the third operation mode, a third switching signal may continue to be output. While the third switching signal continues to be output, the output power of the first resonant circuit, which includes the first heating coil 230 and the first resonant capacitor 250, and the second resonant circuit, which includes the second heating coil 240 and the second resonant capacitor 260, reaches its maximum. That is, as illustrated in FIG. 15, in response to the third switching signal continuing to be output, that is, in a case in which there is no "OFF" period of the third switching signal, the output powers of the first and second resonant circuits reach their maximum.

Referring to FIG. 16, the output powers of the first and second resonant circuits may be controlled by adjusting the "ON" or "OFF" period of the third switching signal. More specifically, as illustrated in FIG. 16, an "OFF" period 'd' during which the third switching signal is not output is provided in each resonant period. During the "OFF" period 'd', the first and second resonant circuits stop operating, and thus, no power is generated.

Accordingly, due to the existence of the "OFF" period 'd' in each resonant period, the output power of the first or second resonant circuit is reduced from its maximum as illustrated in FIG. 15 by as much as the amount of power not generated during the "OFF" period 'd'.

That is, during the third operation mode, the "ON" and "OFF" periods of the third switching signal may be adjusted in response to receipt of a power adjustment command of burner inputted from an external source, thereby allowing the first and second resonant circuits to operate with power corresponding to the burner output power adjustment command.

During the third operation mode, the first and second resonant circuits operate with the same power.

Figure 17:
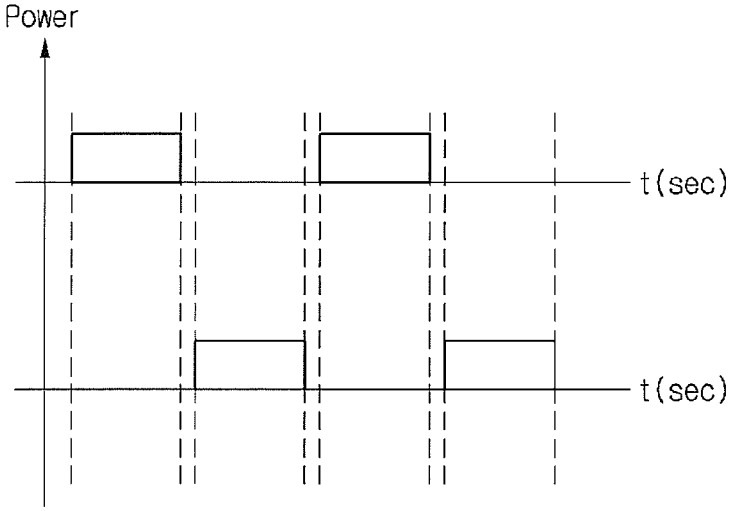
FIGS. 17 and 18 illustrate methods of controlling the output level of an electronic induction heating cooker in the fourth operation mode.
Figure 18:
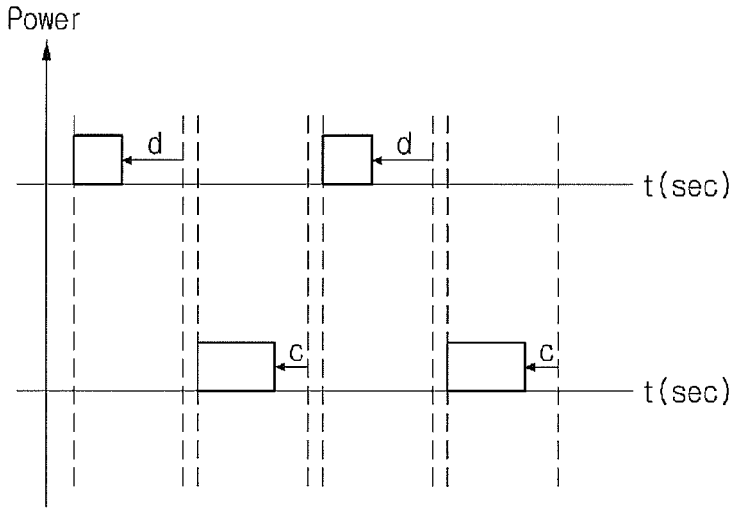

FIGS. 17 and 18 illustrate a method of controlling the output level of the electronic induction heating cooker 200 in the fourth operation mode.

Referring to FIGS. 17 and 18, during the fourth operation mode, a fourth switching signal may continue to be output. That is, during the fourth operation mode, the first and second switching signals may be alternately output. In response to the first and second switching signals being alternately output, the output powers of the first and second resonant circuits reach their maximum. That is, as illustrated in FIG. 17, in a case in which the first and second switching signals are alternately output with no "OFF" period therebetween, the output powers of the first and second resonant circuits reach their maximum.

Referring to FIG. 18, the output powers of the first and second resonant circuits may be controlled by adjusting the "OFF" periods of the first and second switching signals. For example, during a first resonant period, the first switching signal may be output. An "OFF" period d during which the first switching signal is not output may be set in the first resonant period, thereby adjusting the output power of the first resonant circuit.

Similarly, during a second resonant period, the second switching signal may be output. An "OFF" period 'c' during which the second switching signal is not output may be set in the second resonant period, thereby adjusting the output power of the second resonant circuit. The length of the "OFF" period 'd' may be different from the length of the "OFF" period 'c'. That is, the duration for which the first switching signal is not output may be different from the duration for which the second switching signal is not output. Accordingly, during the fourth operation mode, unlike during the third operation mode, the output power of the first resonant circuit and the output power of the second resonant circuit may be controlled separately.

Figure 19:
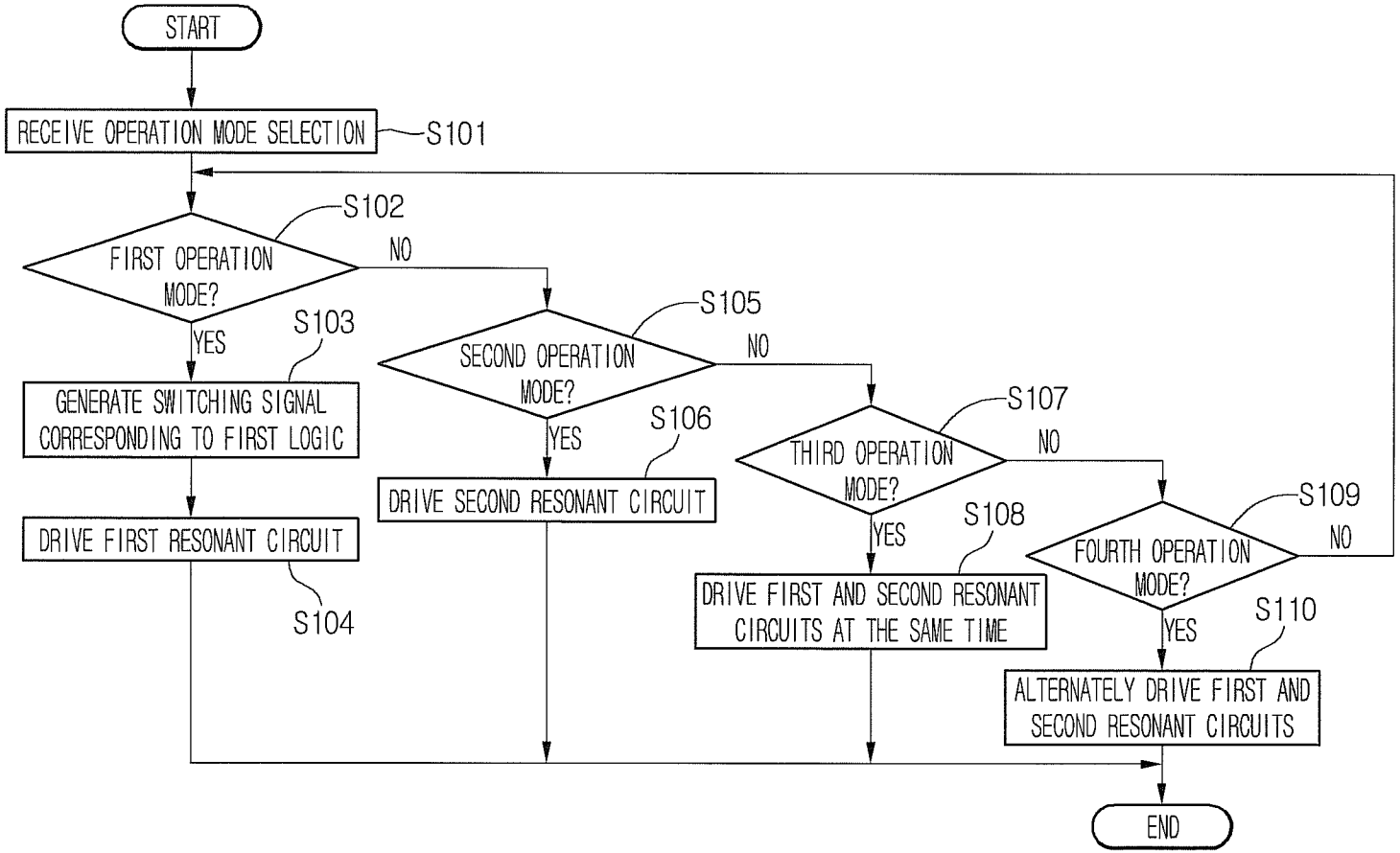
FIG. 19 is a flowchart of a driving method of an electronic induction heating cooker, according to an embodiment as broadly described herein.
Figure 20:
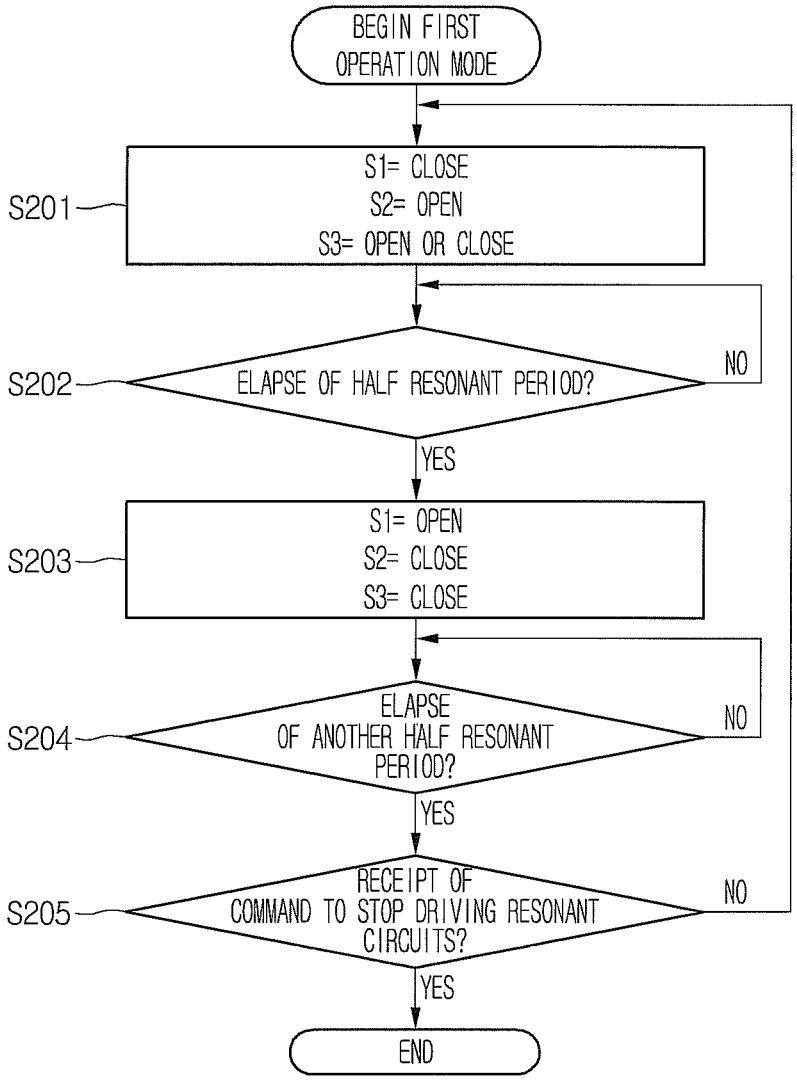
FIG. 20 is a detailed flowchart of a first operation mode of the method shown in FIG. 19.
Figure 21:
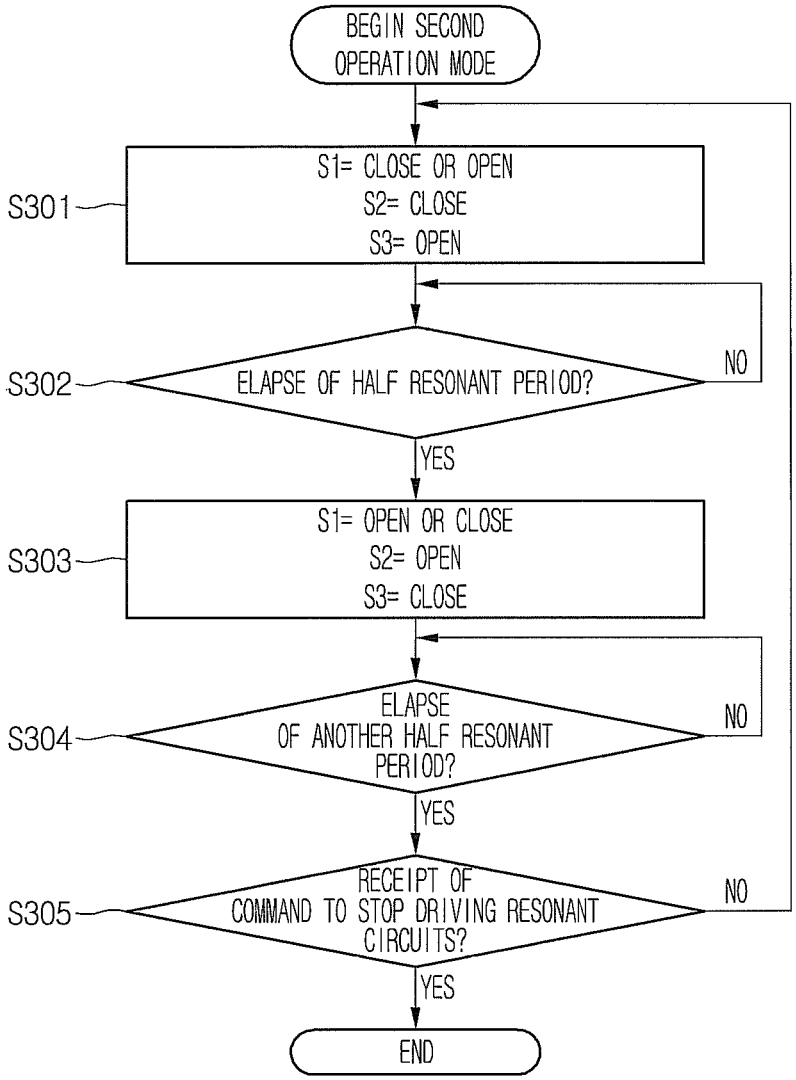
FIG. 21 is a detailed flowchart of a second operation mode of the method shown in FIG. 19.
Figure 22:
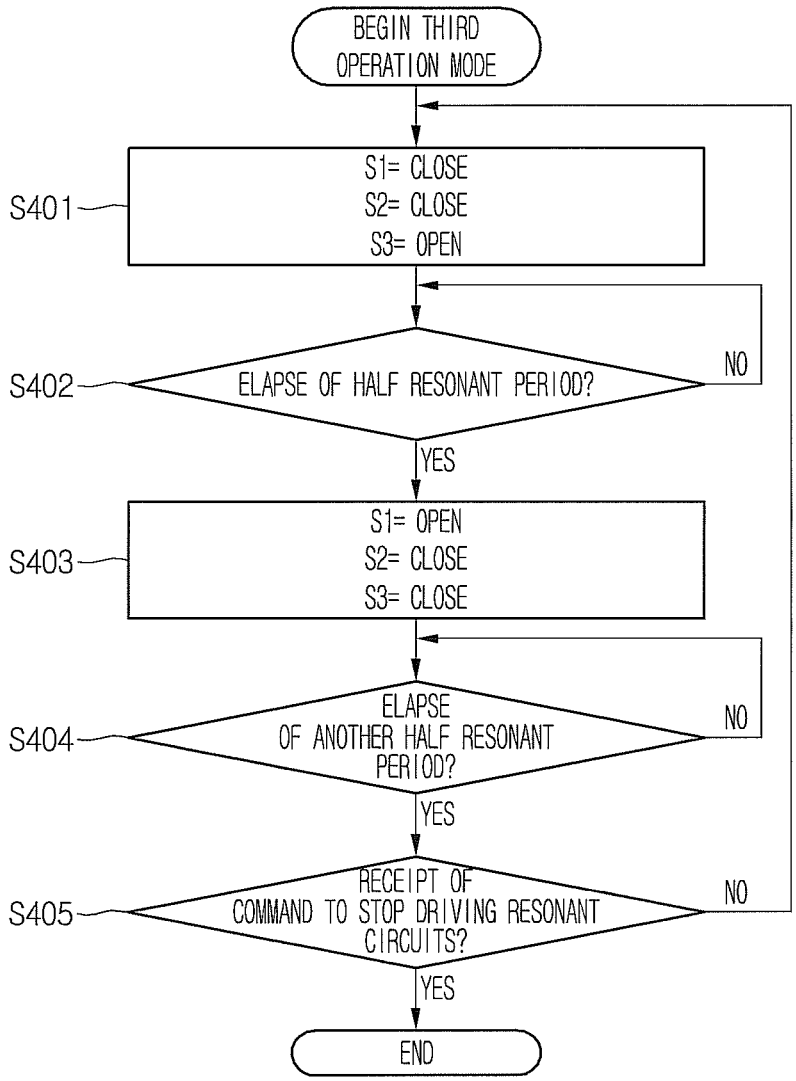
FIG. 22 is a detailed flowchart of a third operation mode of the method shown in FIG. 19.
Figure 23:
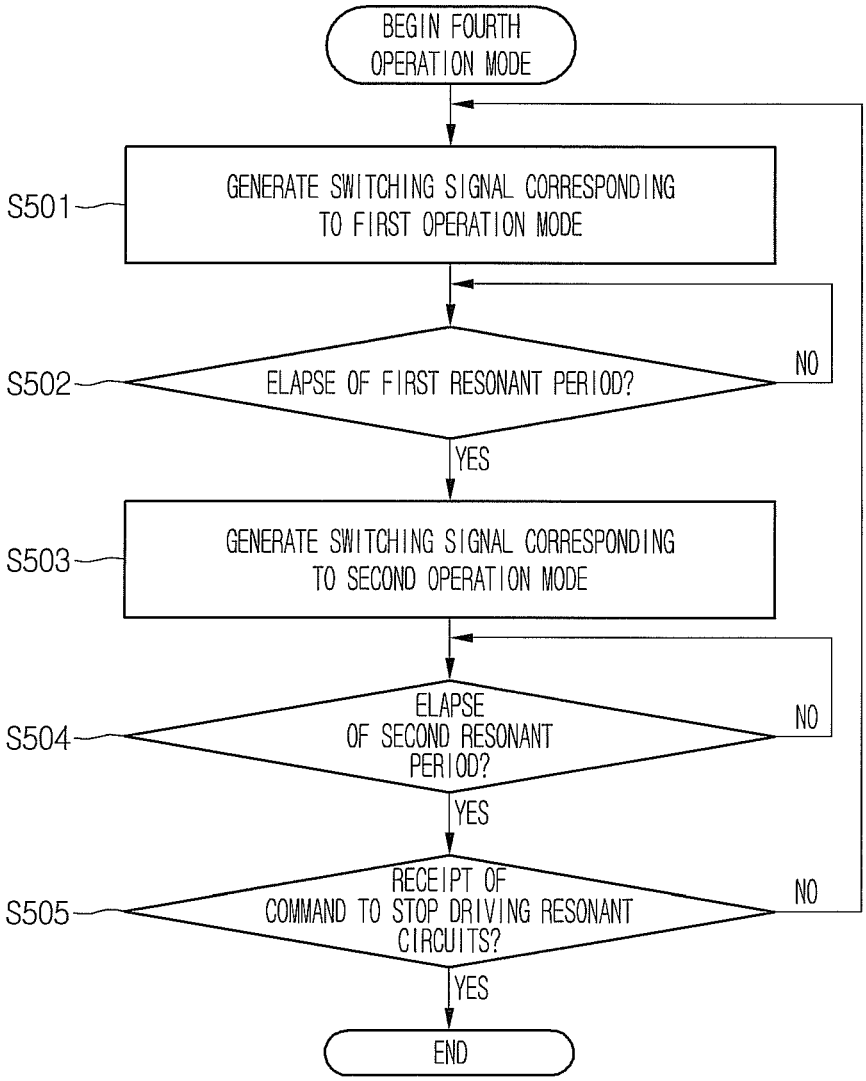
FIG. 23 is a detailed flowchart of a fourth operation mode of the method shown in FIG. 19.
Figure 24:
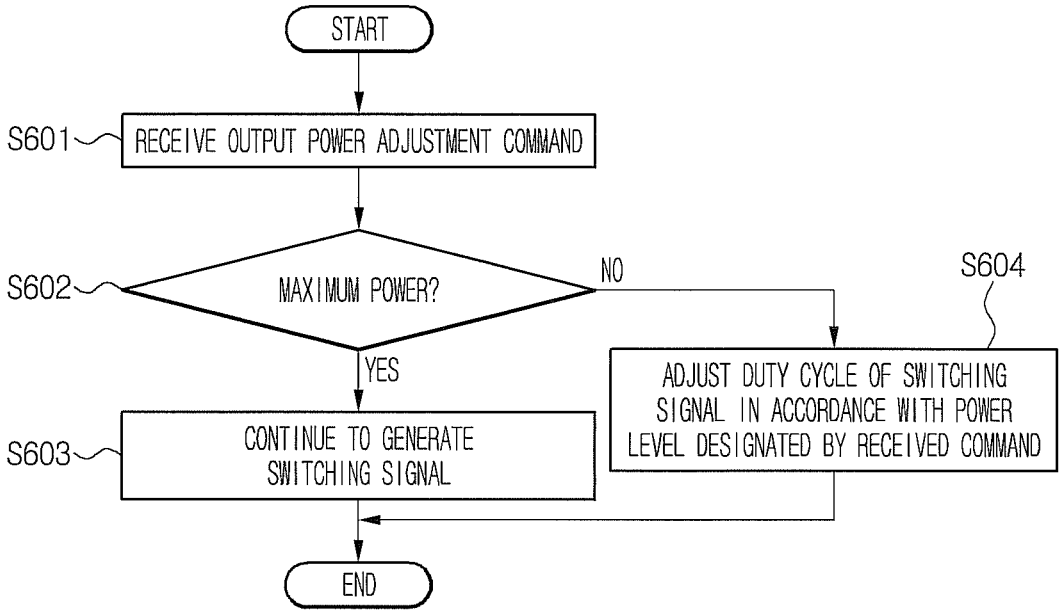
FIG. 24 is a flowchart of an output level control method of an electronic induction heating cooker, according to an embodiment as broadly described herein.

FIG. 19 is a flowchart of a driving method of an electronic induction heating cooker, according to an embodiment, FIG. 20 is a detailed flowchart of a first operation mode of the method shown in FIG. 19, FIG. 21 is a detailed flowchart of a second operation mode, FIG. 22 is a detailed flowchart of a third operation mode, FIG. 23 is a detailed flowchart of a fourth operation mode, and FIG. 24 is a flowchart of an output level control method of an electronic induction heating cooker, according to an embodiment.

Referring to FIG. 19, the operation mode selector 280 receives an operation mode selection signal from an external source (S101). In response to the receipt of the operation mode selection signal, the operation mode selector 280 transmits information on an operation mode selected by the operation mode selection signal to the switching controller 270.

The switching controller 270 determines whether the selected operation mode is a first operation mode (S102). That is, the switching controller 270 determines whether the first operation mode, which is for driving only the first heating coil 230, has been selected.

In response to the first operation mode being determined (S102) to have been selected, the switching controller 270 generates a switching signal corresponding to first logic, i.e., a first switching signal, so as to control the first to third switches S1 to S3 included in the inverter 220 (S103). In response to the inverter 220 being driven by the first switching signal, the first resonant circuit including the first heating coil 230 and the first resonant capacitor 250 is driven (S104).

If the switching controller 270 determines that the first operation mode has not been selected (S102), the switching controller 270 determines whether the selected operation mode is a second operation mode (S105). That is, the switching controller 270 determines whether the second operation mode, which is for driving only the second heating coil 240, has been selected.

In a case in which the second operation mode is determined (S105) to have been selected, the switching controller 270 generates a switching signal corresponding to second logic, i.e., a second switching signal, so as to control the first to third switches S1 to S3 included in the inverter 220. In response to the inverter 220 being driven by the second switching signal, the second resonant circuit including the second heating coil 240 and the second resonant capacitor 260 is driven (S106).

If the switching controller 270 determines that the second operation mode has not been selected (S105) the switching controller 270 determines whether the selected operation mode is a third operation mode (S107). That is, the switching controller 270 determines whether the third operation mode, which is for driving a plurality of heating coils at the same time, has been selected.

In response to the third operation mode being determined (S107) to have been selected, the switching controller 270 generates a switching signal corresponding to third logic, i.e., a third switching signal, so as to control the first to third switches S1 to S3 included in the inverter 220. In response to the inverter 220 being driven by the third switching signal, the first resonant circuit including the first heating coil 220 and the first resonant capacitor 250 and the second resonant circuit including the second heating coil 240 and the second resonant capacitor 260 are both driven at the same time (S108).

If the switching controller 270 determines that the third operation mode has not been selected (S107), the switching controller 270 determines whether the selected operation mode is a fourth operation mode (S109). That is, the switching controller 270 determines whether the fourth operation mode, which is for alternately driving a plurality of heating coils, has been selected.

In response to the fourth operation mode being determined (S109) to have been selected, the switching controller 270 generates a switching signal corresponding to fourth logic, i.e., a fourth switching signal, so as to control the first to third switches S1 to S3 included in the inverter 220. In response to the inverter 220 being driven by the fourth switching signal, the first resonant circuit including the first heating coil 220 and the first resonant capacitor 250 is driven during a first resonant period, and the second resonant circuit including the second heating coil 240 and the second resonant capacitor 260 is driven during a second resonant period (S110).

Referring to FIG. 20, in response to the first operation mode being selected, the switching controller 270 closes the first switch S1, opens the second switch S2 and opens or closes the third switch S3 (S201).

The switching controller 270 determines whether half a resonant period has elapsed since completing operation S201 (S202).

In response to half a resonant period being determined (S202) to have elapsed since completing operation S201, the switching controller 270 opens the first switch S1, closes the second switch S2, and closes the third switch S3 (S203).

The switching controller 270 then determines whether half a resonant period has elapsed since completing operation S203 (S204).

In response to half a resonant period being determined (S204) to have passed since operation S203, the switching controller 270 determines whether a command to stop driving resonant circuits has been received (S205).

In response to the command to stop driving the first and/or second resonant circuit(s) being determined (S205) to have been received, the first operation mode is terminated. On the other hand, if the command to stop driving resonant circuits has not been received (S205), the switching controller 270 returns to operation S201.

Referring to FIG. 21, in response to the second operation mode being selected, the switching controller 270 opens or closes the first switch S1, closes the second switch S2 and opens the third switch S3 (S301).

The switching controller 270 then determines whether half a resonant period has elapsed since completing operation S301 (S302).

In response to half a resonant period being determined (S302) to have elapsed since completing operation S301, the switching controller 270 opens or closes the first switch S1, opens the second switch S2, and closes the third switch S3 (S303).

The switching controller 270 then determines whether half a resonant has elapsed since completing operation S303 (S304).

In response to half a resonant period being determined (S304) to have passed since operation S303, the switching controller 270 determines whether a command to stop driving the first and/or second resonant circuit(s) has been received (S305).

If the command to stop driving resonant circuits has been received (S305), the second operation mode is terminated. On the other hand, if the command to stop driving resonant circuits has not been received (S305), the switching controller 270 returns to operation S301.

Referring to FIG. 22, in response to the third operation mode being selected, the switching controller 270 closes the first and second switches S1 and S2 and opens the third switch S3 (S401).

The switching controller 270 determines whether half a resonant period has elapsed since completing operation S401 (S402).

In response to half a resonant period being determined (S402) to have elapsed since completing operation S401, the switching controller 270 opens the first switch S1 and closes the second and third switches S2 and S3 (S403).

The switching controller 270 then determines whether half a resonant period has elapsed since completing operation S403 (S404).

If half a resonant period has elapsed since completing operation S403, the switching controller 270 determines whether a command to stop driving the first and/or second resonant circuit(s) has been received (S405).

In response to the command to stop driving resonant circuits being determined (S405) to have been received, the third operation mode is terminated. On the other hand, if the command to stop driving resonant circuits has not been received (S405), the switching controller 270 returns to operation S401.

Referring to FIG. 23, in response to the fourth operation mode being selected, the switching controller 270 generates a switching signal for driving the first resonant circuit during a first resonant period (S501).

The switching controller 270 then determines whether the first resonant period has elapsed (S502).

In response to the first resonant period being determined (S502) to have elapsed, the switching controller 270 generates a switching signal for driving the second resonant circuit during a second resonant period (S503).

The switching controller 270 determines whether the second resonant period has passed (S504).

In response to the second resonant period being determined (S504) to have elapsed, the switching controller 270 determines whether a command to stop driving the first and/or second resonant circuit(s) has been received (S505).

In response to the command to stop driving resonant circuits being determined (S505) to have been received, the fourth operation mode is terminated. On the other hand, in response to the command to stop driving resonant circuits being determined (S505) to have not been received, the switching controller 270 returns to operation S501.

Referring to FIG. 24, the switching controller 270 receives an output power adjustment command from an external source (S601).

The output power adjustment command may be issued differently for different operation modes. More specifically, the output power adjustment command may be issued only for the first resonant circuit during the first operation mode, and may be issued only for the second resonant circuit during the second operation mode.

During the third operation mode, the output power adjustment command may be issued for both the first and second resonant circuits, but may not allow different output power settings for the first and second resonant circuits.

During the fourth operation mode, the output power adjustment command may be issued for both the first and second resonant circuits, and may allow different output power settings for the first and second resonant circuits.

The switching controller 370 determines whether the received output power adjustment command designates a maximum power level (S602).

In response to the received output power adjustment command being determined (S602) to designate the maximum power level, the switching controller 270 continues to generate the switching signal without providing an "OFF" period during which a switching signal is output (S603).

On the other hand, if the received output power adjustment command does not designate the maximum power level (S602), the switching controller 270 adjusts the "OFF" period such that the maximum power level can be generated by the first and second resonant circuits (S604).

According to embodiments, a plurality of heating coils may be driven by a single inverter with three switching devices, the volume of an induction heating cooker may be reduced by simplifying the circuitry, and the manufacturing cost of an induction heating cooker may be reduced.

According to embodiments, user satisfaction may be improved by driving a plurality of heating coils at the same time using a single inverter with three switching devices.

According to embodiments, no additional switches for driving a plurality of heating coils are required because of the use of a single inverter. Accordingly, the reliability of an induction heating cooker may be improved by preventing noise generated by such switches.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Embodiments provide an electronic induction heating cooker, which is capable of driving two resonant circuits using an inverter with three switching devices while preventing or reducing noise that may be generated during the driving of the resonant circuits, and an output level control method of the electronic induction heating cooker.

Embodiments also provide an electronic induction heating cooker, which is capable of adjusting the output powers of two resonant circuits using an inverter with three switching devices, and an output level control method of the electronic induction heating cooker.

In one embodiment, an electronic induction heating cooker as embodied and broadly described herein may include a rectifier configured to rectify an input voltage into a direct current (DC) voltage and output the DC voltage, an inverter configured to comprise first, second and third switches connected in series between a positive power source terminal and a negative power source terminal and generate an alternating current (AC) voltage by switching the DC voltage, a first heater configured to be driven by the AC voltage so as to heat a first cooking container, a second heater configured to be connected in parallel to the first heater, and to be driven by the AC voltage so as to heat a second cooking container, and a switching controller configured to generate a switching signal for controlling the first and second heaters in accordance with a set of operating conditions input thereto and adjust a duty of the switching signal.

In another embodiment, a method of adjusting the output power of an electronic induction heating cooker, which has a resonant circuit including first and second heaters and an inverter including first, second and third switches connected in series, may include receiving a first operating condition for determining an operation mode, determining a switching signal corresponding to the first operating condition, receiving a second operating condition; determining "ON" and "OFF" periods of the switching signal in accordance with the second operating condition, and outputting the switching signal during the "ON" period.

According to embodiments as broadly described herein, a plurality of heating coils may be driven by using a single inverter with three switching devices, the volume of an induction heating cooker may be reduced by simplifying the circuitry, and the manufacturing cost of an electronic induction heating cooker may be reduced.

According to embodiments as broadly described herein, user satisfaction may be improved by driving a plurality of heating coils at the same time using a single inverter with three switching devices.

According to embodiments as broadly described herein, no additional switches for driving a plurality of heating coils are required because of the use of a single inverter. Accordingly, the reliability of an electronic induction heating cooker may be improved by preventing noise generated by such switches.

According to embodiments as broadly described herein, the state of an electronic induction heating cooker may be appropriately controlled by adjusting the intensity of heat generated by a plurality of heating coils using a single inverter.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of adjusting an output power of an electronic induction heating cooker, the electronic induction heating cooker including a resonant circuit including first and second heaters and an inverter, the inverter including first, second, and third switches connected in series, the method comprising:

receiving a first operating condition and determining an operation mode from the received first operating condition;

determining a switching signal corresponding to the first operating condition;

receiving a second operating condition;

determining ON and OFF periods of the switching signal in accordance with the second operating condition; and outputting the switching signal during the ON period, wherein the determination of the operation mode includes designating at least one of a plurality of operation modes, including:

designating a first operation mode for driving only the first heater by outputting a first switching signal;

designating a second operation mode for driving only the second heater by outputting a second switching signal;

designating a third operation mode for simultaneously driving both the first and second heaters; or designating a fourth operation mode for alternately driving the first and second heaters, wherein the switching signal controls the first, second, and third switches of the inverter to be open or dosed corresponding to the designated one of the plurality of operation modes, wherein the determination of the ON and OFF periods includes adjusting the ON and OFF periods of the switching signal to set an output power level of the first heater or the second heater, wherein, in response to the designation of the third operation mode, the determination of the switching signal includes outputting a third switching signal for controlling the first and third switches to be alternately open and controlling the second switch to continue to be closed, and the determination of the ON and OFF periods includes determining the output powers of the first and second heaters by adjusting ON and OFF periods of the third switching signal, wherein, in response to the designation of fourth operation mode, the determination of the switching signal further includes alternately ouputting the first and second switching signals at regular intervals of time, and the determination of ON and OFF periods further includes determining the output powers of the first and second heaters by adjusting ON and OFF periods of each of the first and second switching signals, and wherein the ON and OFF periods of the first switching signal are adjusted separately and differently from the ON and OFF periods of the second switching signal.

2. The method of claim 1, wherein, in response to the designation of the first operation mode, the determination of the switching signal includes outputting the first switching signal for controlling the first and second switches to be alternately open and controlling the third switch to either continue to be closed, or be open or closed in synchronization with the second switch, and the determination of the ON and OFF periods includes determining the output power of the first heater by adjusting the ON and OFF periods of the first switching signal.

3. The method of claim 2, wherein, in response to the designation of the second operation mode, the determination of the switching signal further includes outputting the second switching signal for controlling the second and third switches to be alternately open and controlling the first switch to either continue to he open or closed, and the determination of the ON and OFF periods further includes determining the output power of the second heater by adjusting the ON and OFF periods of the second switching signal.

4. The method of claim 2, wherein the first switching signal controls the first and second switches to be alternately open when a half of a resonant period of time of the resonant circuit including the first heater is elapsed.

5. The method of claim 3, wherein the second switching signal controls the second and third switches to be alternately open when a half of a resonant period of dine of the resonant circuit including the second heater is elapsed.

6. The method of claim 1, wherein the third switching signal controls the first and third switches to be alternately open when a half of a resonant period of time of the resonant circuit including the first and second heaters is elapsed.

7. The method of claim 1, wherein the first switching signal is output for a first resonant period of time of a first resonant circuit including the first heater, and wherein when the first resonant period of time is elapsed, the second switching signal is output for a second resonant period of time of a second resonant circuit including the second heater.

8. A method of controlling an electronic induction heating cooker including a resonant circuit including first and second heaters and an inverter including first, second, and third switches connected in series, the method comprising:

receiving a first operating command and designating one of a plurality of operation modes for the, first and second heaters based on the received first operating command;

determining a switching signal corresponding to the designated one of the plurality of operation modes;

receiving a second operating command;

determining ON and OFF periods of the switching signal in accordance with the second operating command; and operating the first and second heaters in accordance with the switching signal, wherein the switching signal controls the first, second, and third switches of the inverter to be open or closed corresponding to the desIgn one of the plurality of operation modes, wherein the determination of the ON and OFF periods includes adjusting the ON and OFF periods of the switching signal to set an output power level of the first heater or the second heater, wherein the designation of one of the plurality of operation modes for the first and second heaters includes designating a third operation mode, among first, second, third, and fourth operation modes of the plurality of operation modes, simultaneously operating the first and second heaters, wherein the determination of the switching signal includes generating a third switching signal for alternately opening the first and third switches and maintaining a closed position of the second switch, wherein the determination of the ON and OFF periods includes adjusting ON and OFF periods of first and second switching signals to set the output power levels of the first and second heaters, wherein the designation of one of the plurality of operation modes for the first and second heaters includes designating the fourth operation mode alternately operating the first and second heaters, wherein the determination of the switching signal includes alternately outputting the first switching signal and the second switching signal at regular intervals of time, and wherein the determination of the ON and OFF periods includes adjusting the ON and OFF periods of the first switching signal separately and differently from the ON and OFF periods of the second switching signal to set the output power level of the first and second heaters.

9. The method of claim 8, wherein the designation of one of the plurality of operation modes for the first and second heaters includes designating the first operation mode operating only the first heater, wherein the determination of the switching signal includes generating the first switching signal for alternately opening the first and second switches and either maintaining a closed position of the third switch or opening or closing the third switch in synchronization with the second switch, and wherein the determination of the ON and OFF periods includes adjusting the ON and OFF period of the first switching signal to set the output power level of the first heater.

10. The method of claim 9, wherein the first switching signal controls the first and second switches to he alternately open when a half of a resonant period of time of the resonant circuit including the first heater is elapsed.

11. The method of claim 8, wherein the designation of one of the plurality of operation modes for the first and second heaters includes designating the second operation mode operating only the second heater, wherein the determination of the switching signal includes generating the second switching signal for alternately opening the second and third switches and maintaining a position of the first switch, and wherein the determination of the ON and OFF periods includes adjusting the ON and OFF periods of the second switching signal set the output power level of the second heater.

12. The method of claim 11, wherein the second switching signal controls the second and third switches to be alternately open when a half of a resonant period of time of the resonant circuit including the second heater is elapsed.

13. The method of claim 8, wherein the first switching signal includes alternately opening the first and second switches and either maintaining closed position of the third switch or opening or closing the third switch in synchronization with the second switch, and wherein the second switching signal includes alternately opening the second and third switches and maintaining a position of the first switch.

14. The method of claim 8, wherein the third switching signal controls the first and third switches to be alternately open when a half of a resonant period of time of the resonant circuit includin the first and second heaters is elapsed.

15. The method clam 8, wherein the first switching signal is output for a first resonant period of time of a first resonant circuit including the first heater, and wherein when the first resonant period of is elapsed, the second switching signal is output for a second resonant period of time of a second resonant circuit including the second heater.

* * * * *